United States Patent [19]

Havey

[11] 4,151,630

[45] May 1, 1979

[54] DISPOSABLE CASKET

[76] Inventor: Ambrose S. Havey, 107 N. Broadway, Yonkers, N.Y. 10701

[21] Appl. No.: 847,403

[22] Filed: Oct. 31, 1977

Related U.S. Application Data

[63] Continuation-in-part of Ser. No. 718,114, Aug. 27, 1976, Pat. No. 4,063,337.

[51] Int. Cl.[2] ..... A61G 17/00

[52] U.S. Cl. ..... 27/2; 27/4

[58] Field of Search ..... 27/2, 3, 11, 4

[56] References Cited

U.S. PATENT DOCUMENTS

| | | | |
|---|---|---|---|
| 1,330 | 8/1862 | Scollay | 27/11 |
| 678,348 | 7/1901 | Nichols | 27/3 |
| 748,692 | 1/1904 | Booth | 27/2 |
| 1,431,727 | 10/1922 | Dunn | 27/2 |
| 1,503,958 | 8/1924 | McCampbell | 27/11 |
| 1,887,665 | 11/1932 | Truman | 27/2 X |
| 2,247,617 | 7/1941 | Metz | 27/11 X |
| 2,655,712 | 10/1953 | Glassner | 27/2 |
| 3,488,818 | 1/1970 | Orr | 27/2 |

*Primary Examiner*—John D. Yasko
*Attorney, Agent, or Firm*—Anthony H. Handal

[57] ABSTRACT

A disposable casket adapted to rest on a platform is disclosed. The casket comprises bedding which rests in a casket bottom element. An outer casket shell is disposed over and around the casket bottom element. This outer casket shell includes a top planar element which has a viewing means to allow visitors to see the face of the deceased.

The inventive casket may be made of waxed-treated cardboard to keep costs to a minimum. The effects of decomposition may be neutralized to some extent by the provision of compartments containing a deodorizer, a desiccant, and/or a perfumery or fragrance-bearing material.

10 Claims, 6 Drawing Figures

10
12
14
16
18
20
22
24
26
28
30
32
34
36
38
40
42
43
44
46
48
50
52
54
56
58
60

DISPOSABLE CASKET

CROSS-REFERENCE TO RELATED APPLICATION

This application is a continuation in part of U.S. patent application Ser. No. 718,114 of Ambrose Havey, filed Aug. 27, 1976 and entitled Multi-element Casket now U.S. Pat. No. 4,063,337.

BACKGROUND OF THE INVENTION

In recent years, the rapidly accelerating cost of funeral services has become the object of mounting public concern. Although modern techniques could probably do much to reduce these costs, funerals have resisted the application of technology largely because of the solemnity and traditional conservativeness of the funeral ceremony. Thus, coffins, caskets, head stones, and the like are prepared by means of conventional techniques which require the expenditure of extensive hand workmanship and traditional materials.

In the above-referenced patern application entitled Multi-element Casket, which is hereby incorporated by reference, I disclosed a very economical apparatus for the display and cremation of the deceased. The casket disclosed there comprises a number of elements and is particularly suited for services involving cremation of the deceased. The casket comprises a container bottom configured and dimensioned to contain suitable bedding which is disposed within the container bottom. A platform supports the container bottom as well as an outer casket shell having sidewalls and an openable top element. In accordance with the apparatus there disclosed the outer casket shell is configured and dimensioned to extend around and be positioned over the container bottom while they both rest on the platform.

One of the advantages of the apparatus disclosed in my earlier application is the ease with which the casket may be transported and stored. Specifically, the actual cremation receptacle comprises a container bottom and support elements which are made in such a manner that they may be folded into compact form. The container further comprises a top which may be folded into a box for containing both the container bottom and the support member. This particular structure is extremely advantageous inasmuch as the outer casket shell is conventional in appearance and is reused, and the disposable part of the casket, namely, the container bottom and, typically, bedding and liner, are relatively inexpensive.

While this arrangement works well in the United States, in some foreign countries furneral services and customs vary quite markedly from those in this country. For example, in Japan the appearance of the casket is not as critical as it is in the United States. Another difference is the fact that the top of the casket, instead of containing a half-door which opens, has a glass window which is provided with a pair of shutters. This is part of a problem caused by a radical difference in undertaking procedures between those of the Far East and those of the West. Specifically, in Japan and a number of other Far Eastern countries the body of the deceased is not embalmed. Hence, decay of the body proceeds at an accelaerated rate. Such decay results in the generation of liquids and vapors. The liquids tend to destroy even conventional wooden caskets. In accordance with the present invention, an inexpensive and novel casket assembly, particularly useful in such circumstances, is described.

SUMMARY OF THE INVENTION

In accordance with the present invention a disposable casket adapted to rest on a support platform is provided. The casket is provided with bedding and a casket bottom configured and dimensioned to contain the bedding. The casket bottom has sidewalls and a bottom planar element. The container bottom is separate from the support platform. An outer casket shell having sidewalls and a top planar element is provided. The top planar element is provided with viewing means.

DETAILED DESCRIPTION OF THE PREFERRED EMBODIMENT

Figures 1, 2, 3, 4, 5, 6:
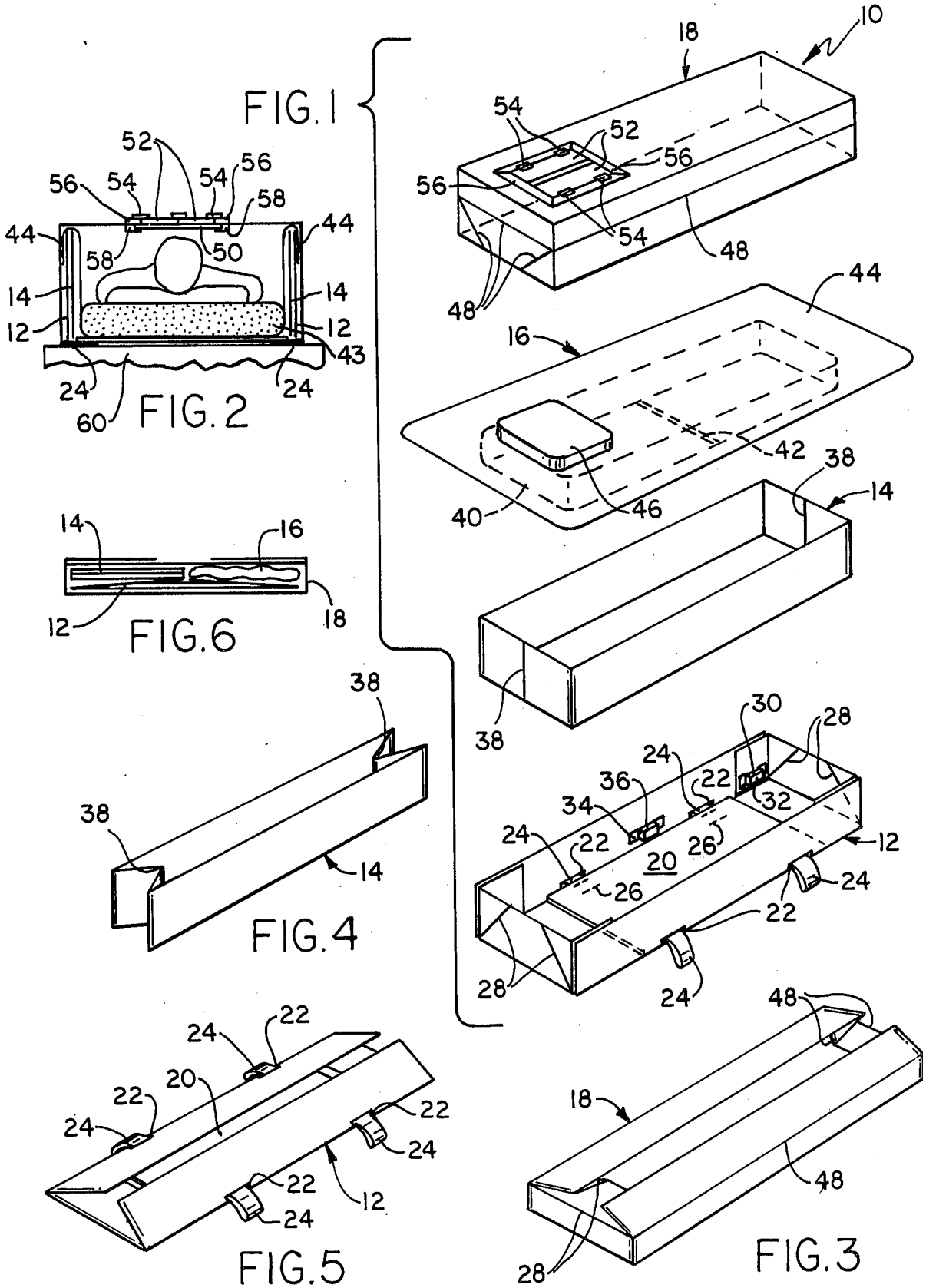
FIG. 1 is an exploded perspective view of the inventive disposable casket.
FIG. 2 is a cross-sectional view showing the inventive casket during use.
FIG. 3 is a perspective view showing the outer casket shell-folded to act as a container for the transport of the elements or the casket.
FIG. 4 is a perspective view of a casket support member folded to be contained in the folded outer casket shell.
FIG. 5 is a perspective view of the casket bottom folded to be contained in the folded outer casket shell.
FIG. 6 is a cross-sectional view of the folded outer casket shell containing the various elements of the inventive disposable casket.

Referring to FIG. 1, we have an exploded perspective view of a disposable multi-element casket 10 constructed in accordance with the present invention. The casket comprises a casket bottom 12 which is maintained in the illustrated unfolded position by a support member 14 which rests inside the casket bottom 12. Bedding 16 rests in casket bottom 12. Casket bottom 12, with support member 14 and bedding 16 is covered with an outer casket shell 18.

Turning next to the construction of the casket bottom 12, we note that it is made of cardboard that has been moisture-proofed by being given a heavy coating of wax. This coating is particularly effective, inasmuch as during the coating process, some of the wax penetrates the surface of the cardboard. The bottom of casket bottom 12 is reinforced by a stiff board 20, which may be made of composition board or any other suitable material. If desired, casket bottom 12 may be provided with four slots 22, through which carrying straps 24 extend. However, it is then necessary to seal the holes with a suitable sealant such as silicone rubber. Straps 24 are secured to board 20 by any suitable method, such as staples 26. Casket bottom 12 may also be folded into compact form by folding along score lines 28. This allows it to be folded into the form illustrated in FIG. 5.

During use, the casket 10 is charged with a desiccant and a deodorizer. A desiccant pad 30, which comprises a desiccant chemical in a cloth container is held by a foldable cardboard compartment 32, which may be punched with a number of holes to promote the moisture absorbing function of the desiccant. This tends to absorb vapors that would otherwise cloud the viewing window of the casket. A second similar foldable compartmemt 34 is provided for containing a deodorant charge 36. Both desiccant pad 30 and deodorant charge 36 would be kept in sealed polyethelene containers until ready for use and then they would be removed from the containers and put in position before use.

Support member 14 is also made of cardboard and may be folded along score lines 38 to assume a flat configuration. Such folding is illustrated in FIG. 4.

Bedding 16 comprises a mattress 40 which includes a zipper 42. Mattress 40 is shipped in the unfilled state and is filled with any suitable filler 43 at the point of use through opened zipper 42. Bedding 16 also includes a liner 44 which is draped around support member 14 and the sidewalls of casket bottom 12 as illustrated in FIG. 2. A pillow 46 may also be included with the bedding and be integral with it.

Outer casket shell 18, also made of cardboard, is foldable along its score lines 48. It can thus assume the position illustrated in FIG. 3. It also includes a viewing window 50. Viewing window 50 sits behind a suitable opening in the top of the outer casket shell. The mounting for the window includes a pair of shutters 52 secured by hinges 54 to molding 56. Glass 50 is secured by molding 58. Both molding 56 and molding 58 may be secured to the outer casket shell by being secured to each other by screws, rivets, or other suitable attachment means.

As noted above, the inventive disposable casket is shipped in compact form as illustrated in cross-section in FIG. 6. Outer casket shell 18 is folded into a box as is illustrated in FIG. 3. Contained therein in folded form are casket botton 12, support member 14 and bedding 16.

When is is desired to use the inventive casket, outer casket shell 18 is opened and casket bottom 12 is removed and expanded as in FIG. 1. Casket bottom 12 is then placed on a support platform 60. (FIG. 2). Support member 14 is then placed in the casket bottom in order to keep it in its expanded form. Bedding 16 is then stuffed and placed in the casket bottom with liner 44 draped over and around support member 14 and the sidewalls of casket bottom 12. Outer casket shell 18 is then placed over the entire assembly.

If desired, the outer casket shell may be decorated with religious symbols. This is in keeping with the nature of funeral services in the Far East. Such decoration may be done by means of decals or other conventional decorative materials.

While an illustrative embodiment of the invention has been described, it is, of course, understood that various modifications will be obvious to those of ordinary skill in the art. Such modifications are within the spirit and scope of the invention which is limited and defined only by the appended claims.

I claim:

1. A disposable casket adapted to rest on a support platform, comprising:

(a) bedding;

(b) a casket bottom configured and dimensioned to contain said bedding, said casket bottom having sidewalls and a bottom planar element, and said casket bottom being separate from said support platform;

(c) an outer casket shell having sidewalls and a top planar element;

(d) viewing means disposed on said top planar element; and (e) means disposed on said casket bottom positioned, configured and dimensioned for allowing said casket bottom to be folded to a configuration where it occupies a smaller volume.

2. A disposable casket as in claim 1, wherein said casket bottom is coated with a material which is impervious to liquids.

3. A disposable casket as in claim 2, wherein said impervious material is wax.

4. A disposable casket as in claim 1, wherein said veiwing means includes a window of transparent material.

5. A disposable casket as in claim 4, wherein said casket bottom includes a quantity of mositure absorbing desiccant.

6. A disposable casket as in claim 1 wherein, said outer casket shell has means disposed on it positioned, configured and dimensioned for allowing it to be folded to form a box for containing said folded casket bottom.

7. A disposable casket as in claim 1 further comprising a foldable support member for maintaining said container bottom in an unfolded position.

8. A multi-element casket as in claim 1, wherein said container bottom further includes a plurality of straps secured to it and extending through holes in said casket bottom.

9. A disposable casket as in claim 8, wherein said container bottom includes a reinforcement member and said straps are secured to said reinforcement member and further including means for sealing the holes through which said straps extend.

10. A disposable casket as in claim 9, wherein said casket bottom includes means for holding a desiccant, a deodorizer or a fragrant material, or any combination of the same.

* * * * *